US009435624B2

(12) United States Patent
Barthelemy et al.

(10) Patent No.: US 9,435,624 B2
(45) Date of Patent: Sep. 6, 2016

(54) SAFETY ARMING SYSTEM FOR AN EXPLOSIVE CHARGE

(71) Applicant: MBDA FRANCE, Le Plessis-Robinson (FR)

(72) Inventors: Patrick Barthelemy, Marmagne (FR); Jean Caillard, Bourges (FR); Laurent Carton, Saint Florent sur Cher (FR); Vincent Rafin, Bourges (FR)

(73) Assignee: MBDA FRANCE, Le Plessis-Robinson (FR)

( * ) Notice: Subject to any disclaimer, the term of this patent is extended or adjusted under 35 U.S.C. 154(b) by 1 day.

(21) Appl. No.: 14/399,338

(22) PCT Filed: May 21, 2013

(86) PCT No.: PCT/FR2013/000131

§ 371 (c)(1),
(2) Date: Nov. 6, 2014

(87) PCT Pub. No.: WO2013/178889

PCT Pub. Date: Dec. 5, 2013

(65) Prior Publication Data

US 2015/0090145 A1 Apr. 2, 2015

(30) Foreign Application Priority Data

May 30, 2012 (FR) ..... 12 01541

(51) Int. Cl.

| | |
|---|---|
| ***F42D 1/04*** | (2006.01) |
| ***F42D 1/05*** | (2006.01) |
| ***F42C 15/184*** | (2006.01) |
| ***F42C 15/188*** | (2006.01) |
| ***F42D 5/00*** | (2006.01) |

(52) U.S. Cl.

CPC ..... *F42D 1/04* (2013.01); *F42C 15/184* (2013.01); *F42C 15/188* (2013.01); *F42D 5/00* (2013.01)

(58) Field of Classification Search

CPC ..... F42C 15/00; F42C 15/18; F42C 15/184; F42C 15/188; F42C 15/192; F42C 15/196; F42D 1/04; F42D 1/05; F42D 5/00

USPC ..... 102/222, 254, 256

See application file for complete search history.

(56) References Cited

U.S. PATENT DOCUMENTS 3,990,368 A * 11/1976 Prescott ..... F42C 1/06 102/273
4,693,180 A * 9/1987 Weber ..... F42C 1/04 102/265

FOREIGN PATENT DOCUMENTS

EP 0410064 A1 1/1991
EP 0463974 A1 1/1992

(Continued)

OTHER PUBLICATIONS

Written Opinion of the International Searching Authority for PCT/FR2013/000131; Nov. 30, 2014.*

(Continued)

*Primary Examiner* — James S Bergin

(74) *Attorney, Agent, or Firm* — Koppel, Patrick, Heybl & Philpott

(57) ABSTRACT

The invention relates to a safety arming system for an explosive charge. According to the invention, the system comprises: an arming actuator (4) for moving a sleeve (19), supporting a detonator (20), from a fixed safety position to a fixed armed position; and a disarming actuator (5) arranged opposite the arming actuator (4) and capable of returning the sleeve (19) from the fixed arming position to the fixed safety position.

9 Claims, 4 Drawing Sheets

(56) References Cited

FOREIGN PATENT DOCUMENTS

| | | | |
|---|---|---|---|
| FR | 2581176 | A1 | 10/1986 |
| GB | 2023777 | A | 1/1980 |

OTHER PUBLICATIONS

International Search Report (PCT/ISA/210) for PCT/FR2013/000131 mailed Jul. 15, 2013.

* cited by examiner

SAFETY ARMING SYSTEM FOR AN EXPLOSIVE CHARGE

The present invention relates to a safety arming system for an explosive charge. Though not exclusively, the arming system of the present invention is particularly suited to the ignition of an explosive charge carried by a projectile, such as a missile.

Arming systems for explosive charges comprising a movable sleeve that carries a detonator for actuating it are already known. Under the action of an actuator, said sleeve can be moved from a safety position in which said detonator is moved away from the explosive charge to an arming position in which said detonator is aligned with said explosive charge. Once such an alignment is achieved, said detonator can be actuated in order to cause the explosion of said charge.

However, it may be that, the alignment of the detonator and explosive charge being achieved, it is not desirable to actuate the explosive charge, for example because the projectile has irremediably diverted from its trajectory towards a target or because said target proves to be friendly rather than hostile.

In such a situation, the system remains armed and the explosive charge will normally be initiated in the planned operating sequence.

The purpose of the present invention is to remedy this drawback by making it possible to disarm said arming system, after it has been armed.

To this end, according to the invention, the safety arming system for an explosive charge, comprising:

- a sleeve that carries a detonator for actuating said explosive charge and which, inside a cylinder, is able to move between a fixed safety position in which said detonator is moved away from said explosive charge, and a fixed arming position in which said detonator is aligned with said explosive charge, and
- an arming actuator for moving said sleeve from said fixed safety position to said fixed arming position, is characterised in that it comprises:

- a disarming actuator arranged opposite said arming actuator with respect to said cylinder, able to return said sleeve from said fixed arming position to said fixed safety position; and
- inside said cylinder, a jacket:
  - inside which said sleeve is able to move, under the action of said arming actuator, from said fixed safety position to said fixed arming position until it is connected to said jacket, in said fixed arming position, by virtue of spontaneous connection means, and
  - which is able, under the action of said disarming actuator, to slide in said cylinder in order to return said sleeve, which has thus become spontaneously connected thereto, from said fixed arming position to said fixed safety position.

Thus, in the event of need, the already armed explosive charge can be disarmed, which eliminates any risk of unwanted explosion.

Such means of spontaneous connection between said sleeve and said jacket may be of the resilient segment and annular groove type. Preferably, the resilient segment is mounted on said jacket whereas the annular groove is formed in the end of the sleeve, advantageously with a frustoconical or similar shape, directed towards the disarming actuator.

Preferably the sleeve, jacket and cylinder are connected together by:

- a first frangible connection, for example a shearing pin, arranged between said sleeve and said jacket, able to be broken by the action of said arming actuator,
- a second breakable connection, also for example a shearing pin, arranged between said jacket and said cylinder, able to be broken by the action of said disarming actuator, and
- a stop system able to prevent said jacket from moving to the arming position under the action of the arming actuator.

Such a stop system, able to prevent said jacket from moving to the arming position under the action of said arming actuator, may also be of the resilient segment and annular rib type. In this case, the resilient segment is preferably mounted on said cylinder whereas said annular rib is carried by said jacket.

Moreover, it is preferable, when, under the action of said disarming actuator, said jacket has slid in said cylinder in order to return said sleeve from said fixed arming position to said fixed safety position, for the position of said jacket to be fixed by locking means. Such locking means may also be of the resilient segment and annular rib type. In addition, they may advantageously use the resilient segment of the stop system between the cylinder and the jacket.

Preferably, in order to increase the safety of the arming system according to the invention, in the safety position before arming, the axis of said detonator is orthogonal to the axis of said explosive charge. Means for rotating the sleeve, inside the jacket, are therefore provided so that, when said sleeve moves under the action of said arming actuator, the axis of said detonator comes, in said fixed arming position, to coincide with the axis of said explosive charge.

Reciprocally, since in said arming position the axis of said detonator is merged with the axis of said explosive charge, it is advantageous to provide means for rotating said sleeve, inside said cylinder, so that, when said sleeve moves under the action of said disarming actuator, the axis of said detonator comes to adopt, in said fixed safety position, an orientation orthogonal to the axis of said explosive charge.

To make remote control possible, it is advantageous for said arming actuator and especially said disarming actuator to be electrically controlled. Preferably, at least one of them is a gas generator with such an electrical control. Thus the gas that it produces moves said sleeve and said jacket, like pistons.

The figures of the accompanying drawing will give a clear understanding of how the invention can be implemented. In these figures, identical references designate similar elements.

Figure 1:
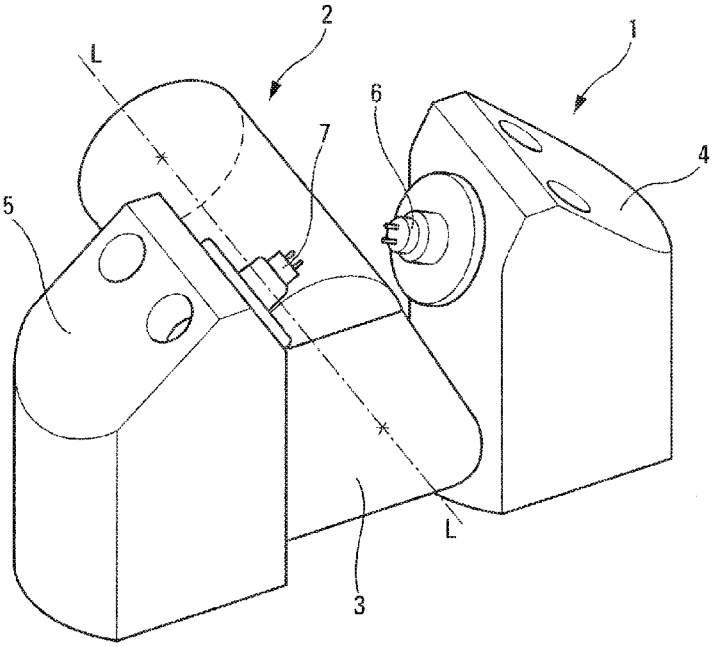
FIG. 1 shows, in schematic perspective, an embodiment of the arming system according to the present invention, as well as an explosive charge intended to be armed by this arming system.
Figure 2:
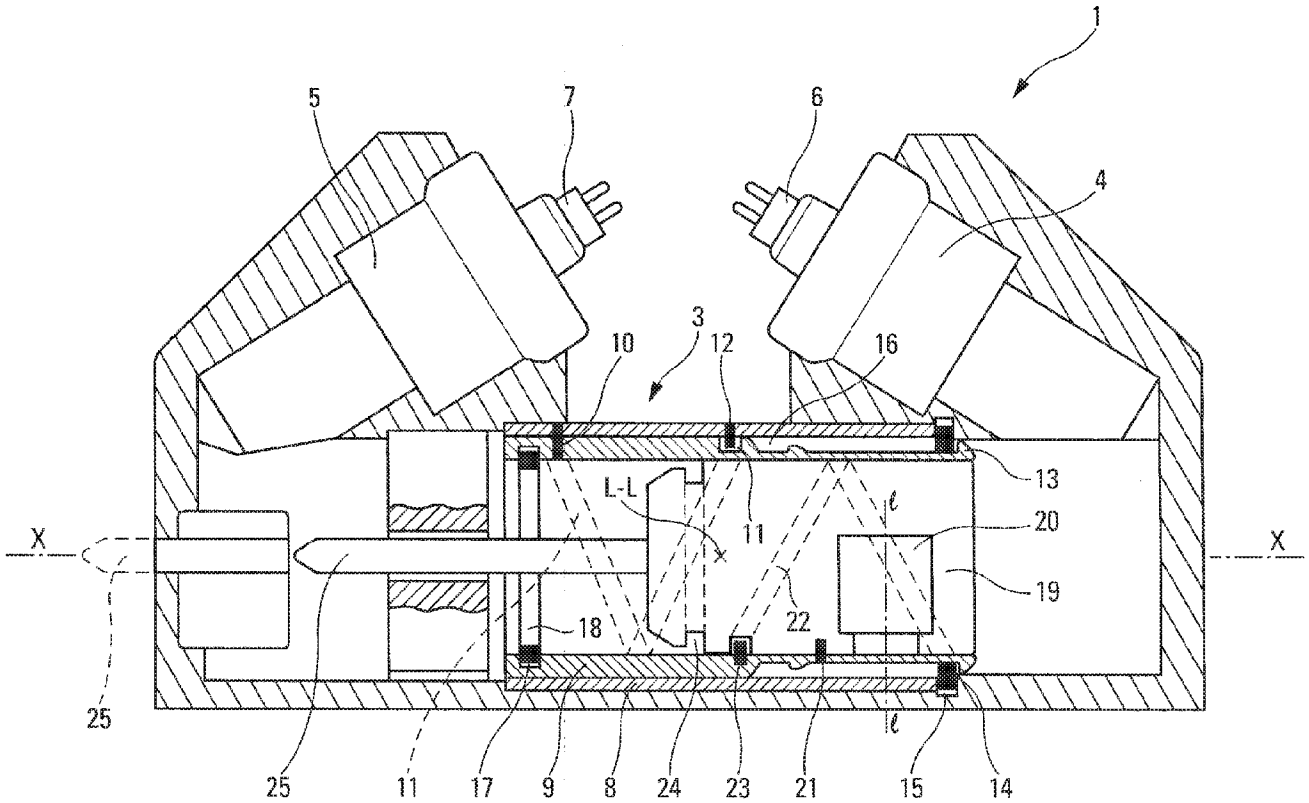
FIG. 2 is a schematic longitudinal section of the arming system of FIG. 1.

The safety arming system 1 according to the invention and shown in FIGS. 1 and 2 is intended to arm an explosive charge 2, of axis L-L. This arming system 1 comprises a body 3 at the ends of which there are respectively mounted, opposite each other, gas generators 4 and 5, electrically controllable by means of respective connectors 6 and 7. In the example depicted, the gas generator 4 forms the actuator for arming the explosive charge 2, whereas the gas generator 5 is provided to serve as an actuator for disarming it.

The body 3 comprises a fixed cylinder 8, of axis X-X, inside which a coaxial cylindrical jacket 9 is arranged able to slide in said fixed cylinder 8, but prevented from doing so by a breakable shearing pin 10. The external cylindrical surface of the jacket 9 carries a helical groove 11 in which a finger 12 for setting in rotation is engaged, connected to the cylinder 8. At its end directed towards the arming generator 4, the jacket 9 comprises a projecting annular peripheral rib 13 cooperating with an annular resilient segment 14, mounted in a groove 15 of said body 3, to form a stop system preventing said jacket 9 from moving from the arming generator 4 towards the disarming generator 5. In addition, the external cylindrical surface of the jacket 9 comprises an annular groove 16 in which said annular resilient segment 14 can be housed in order to connect said jacket 9 to said body 3. Moreover, the internal cylindrical surface of the jacket 9 comprises, on the same side as the disarming generator 5, an annular groove 17 in which an annular resilient segment 18 is housed.

Inside the cylindrical jacket 9 a coaxial sleeve 19 is arranged carrying a detonator 20, of axis I-I. The sleeve 19 is able to slide in the jacket 9 but is prevented from doing so by a breakable shearing pin 21 connected to said jacket 9. The external surface of the sleeve 19 carries a helical groove 22 in which a finger 23 for setting in rotation is engaged, connected to the jacket 9. The end of the sleeve 19 directed towards the disarming generator 5 and the annular resilient segment 18 is partially convergent (frustoconical or the like) and comprises an annular groove 24 able to house said annular resilient segment 18. Moreover, said end of the sleeve 14 comprises a rod 25 able to project outside the body 3 in order to make it possible to view the position of the sleeve inside the system.

In the fixed safety position of the arming system 1 depicted in FIG. 2 the various elements described above are in the following positions:

a) the breakable pin 10 connects the jacket 9 to the fixed cylinder 8, b) the finger 12 for setting in rotation, connected to the fixed cylinder 8, is engaged in the helical groove 11 of the jacket 9, c) the projecting annular groove 13 is in abutment against the annular resilient segment 14, d) the axis I-I of the detonator 20 is at a distance from the axis L-L of the explosive charge 2 and orthogonal thereto, e) the breakable pin 21 connects the sleeve 19 to the jacket 9, and f) the finger 23 for setting in rotation, connected to the jacket 9, is engaged in the helical groove 22 of the sleeve 19.

Figure 3A:
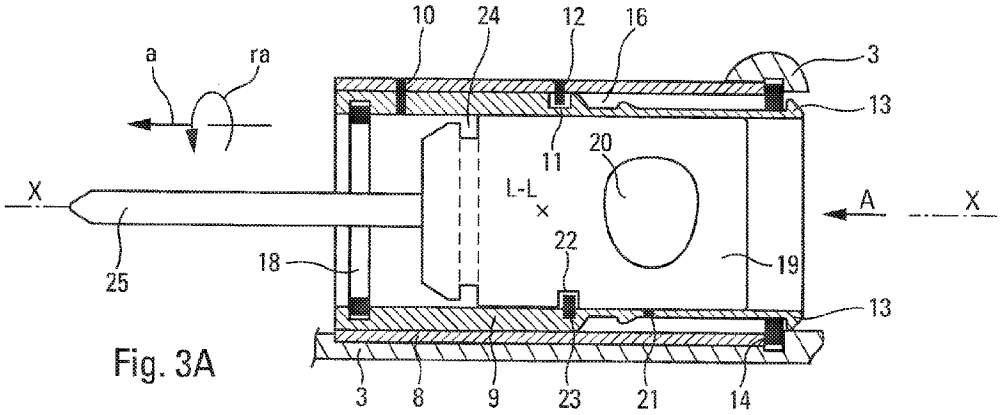
FIGS. 3A and 3B illustrate schematically the process of arming said explosive charge by the system of FIGS. 1 and 2.

As illustrated in FIG. 3A, when the arming actuator formed by the gas generator 4 is operated by means of the connector 6, it exerts a thrust A on the jacket 9 and the sleeve 19. This thrust A has no action on the jacket 9 since said jacket is locked by the stop formed by the projecting annular rib 23 and the annular resilient segment 14. On the other hand, the action of the thrust A on the sleeve 19 causes shearing of the pin 21 and the movement a of said sleeve, inside the jacket 9, in the direction of the disarming actuator formed by the gas generator 5. Because of the connection formed by the finger 23 for setting in rotation and the helical groove 22, this movement a is accompanied by a rotation ra of the sleeve about the axis X-X, which modifies the orientation of the axis I-I of the detonator 20.

The end of travel of the sleeve 19 in the jacket 9 (see FIG. 3B) constitutes the fixed arming position in which the annular resilient segment 18 of the jacket 9 spontaneously engages in the annular groove 24 of the sleeve 19. In this fixed arming position, the axis I-I of the detonator 20 is therefore merged with the axis L-L of the explosive charge 2. In addition, as illustrated in FIG. 2, the end of the rod 25 appears outside the arming device 1, indicating that said arming device is in the armed position.

Figure 3B:
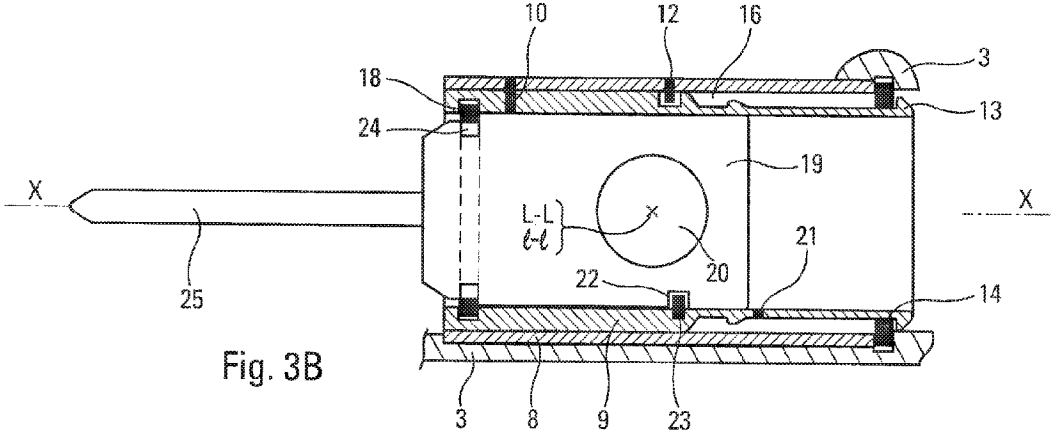
Figure 4A:
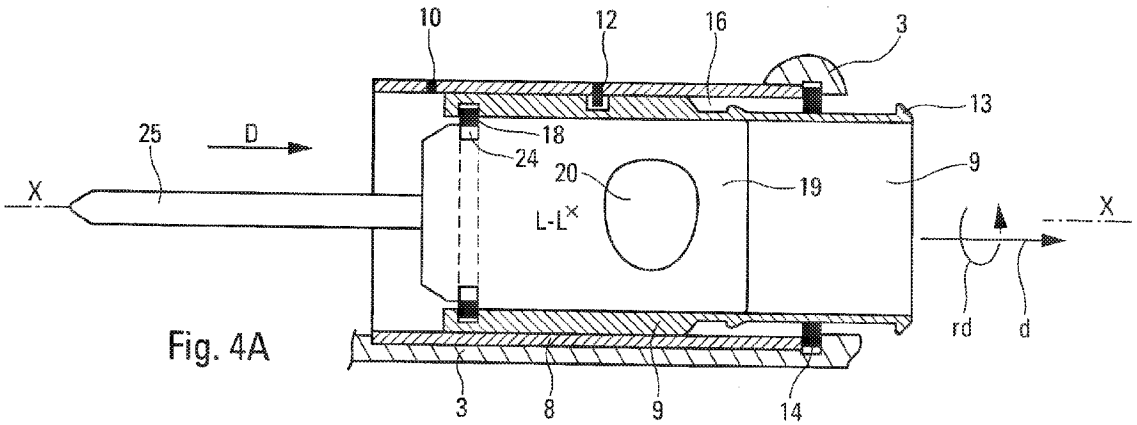
FIGS. 4A and 4B illustrate schematically the process of disarming said explosive charge by the system of FIGS. 1 and 2.

If, when the safety arming system is in the fixed arming position illustrated in FIG. 3B and the functioning of the arming actuator 4 has ceased, the disarming actuator 5 is actuated by means of the connector 7, this actuator 5 exerts a thrust D on the jacket 9 and the sleeve 19, connected by the connection formed by the resilient segment 18 and the annular groove 24. The action of the thrust D on the assembly consisting of the jacket 9 and the sleeve 19 causes shearing of the pin 10 and the movement d of said assembly consisting of the jacket 9 and the sleeve 19, inside the cylinder 8, in the direction of the arming actuator 4. Because of the connection formed by the finger 12 for setting in rotation and the helical groove 11, this movement d (in the opposite direction to the movement a in FIG. 3A) is accompanied by a rotation rd (in a direction opposite to the rotation ra) of the assembly 9-19 about the axis X-X, which modifies once again the orientation of the axis I-I of the detonator 20 (see FIG. 4A).

Figure 4B:
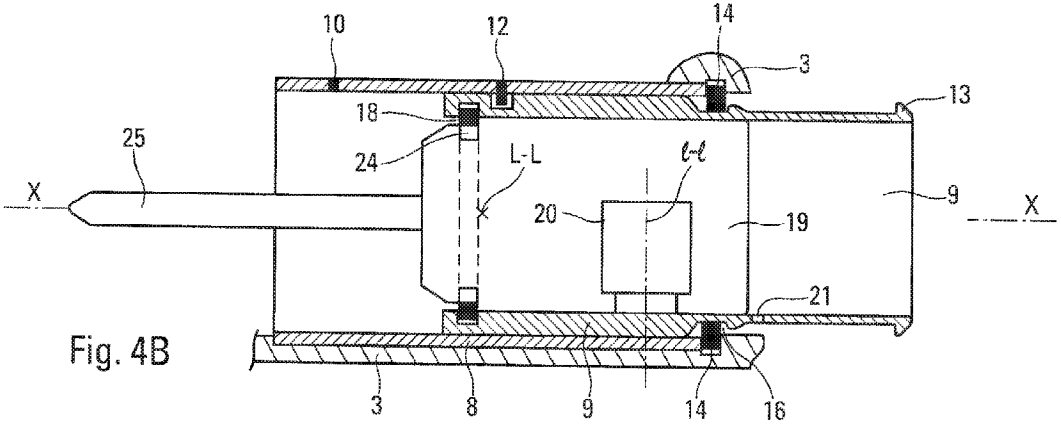

At the end of the movement d of the assembly 9-19 in the cylinder 8 (see FIG. 4B), the detonator 20 is returned to the position that it occupied in the fixed safety position in FIG. 2, with its axis I-I orthogonal to the axis L-L of the explosive charge 2. In this position in FIG. 4B, which corresponds to the safety position, the annular resilient segment 14 has engaged spontaneously in the annular groove 16 of the jacket 9, which ensures the fixity of this position.

The invention claimed is:

1. A safety arming system for an explosive charge, comprising:

a sleeve that carries a detonator for actuating said explosive charge and which, in a cylinder, is able to move between a fixed safety position in which the detonator is away from said explosive charge, and a fixed arming position in which said detonator is aligned with said explosive charge;

an arming actuator for moving said sleeve from said fixed safety position to said fixed arming position;

a disarming actuator arranged opposite said arming actuator with respect to said cylinder, able to return said sleeve from said fixed arming position to said fixed safety position; and a jacket inside said cylinder, inside which said sleeve is able to move, under the action of said arming actuator, from said fixed safety position to said fixed arming position until it is secured to said jacket, in said fixed arming position, by virtue of spontaneous securing means, and which is able, under the action of said disarming actuator, to slide in said cylinder in order to return said sleeve, which has thus become spontaneously fixed thereto, from said fixed arming position to said fixed safety position.

2. The system according to claim 1, wherein said spontaneous means of connection between said sleeve and said jacket are of the resilient segment and annular groove type.

3. The system according to claim 1, further comprising:

a first breakable connection, between said sleeve and said jacket, able to be broken by the action of said arming actuator;

a second breakable connection, between said jacket and said cylinder, able to be broken by the action of said disarming actuator; and a stop system able to prevent said jacket from moving to the arming position under the action of the arming actuator.

4. The system according to claim 3, wherein said stop system able to prevent said jacket from moving to the arming position under the action of said arming actuator is of the resilient segment and annular rib type.

5. The system according to claim 4, wherein said blocking means use the resilient segment of said stop system of said jacket.

6. The system according to claim 1, wherein, when under the action of said disarming actuator said jacket has slid in said cylinder in order to return said sleeve from said fixed arming position to said fixed safety position, the position of said jacket fixed by locking means.

7. The system according to claim 1, wherein, in said safety position before arming, the axis (I-I) of said detonator is orthogonal to the axis (L-L) of said explosive charge and means for rotating the sleeve inside the jacket are provided so that, when said sleeve moves under the action of said arming actuator, the axis (I-I) of said detonator comes, in said fixed arming position, to coincide with the axis (L-L) of said explosive charge.

8. The system according to claim 1, wherein, in said arming position, the axis (I-I) of said detonator being merged with the axis (L-L) of said explosive charge, means for rotating said jacket inside the cylinder are provided so that, when said jacket moves under the action of the disarming actuator, the axis (I-I) of said detonator adopts, in said fixed safety position, an orientation orthogonal to the axis (L-L) of said explosive charge.

9. The system according to claim 1, wherein at least one of the two actuators is an electrically controlled gas generator.

* * * * *